US011808515B2

(12) United States Patent
Bertolini et al.

(10) Patent No.: US 11,808,515 B2
(45) Date of Patent: Nov. 7, 2023

(54) CAN DISPENSER RACK FOR REFRIGERATOR DOOR

(71) Applicants: BSH Home Appliances Corporation, Irvine, CA (US); BSH Hausgerate GmbH, Munich (DE)

(72) Inventors: Nilton Bertolini, Clinton, TN (US); Jorge Carlos Montalvo Sanchez, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/686,482

(22) Filed: Mar. 4, 2022

(65) Prior Publication Data

US 2023/0280091 A1 Sep. 7, 2023

(51) Int. Cl.

| | |
|---|---|
| ***F25D 25/04*** | (2006.01) |
| ***F25D 23/08*** | (2006.01) |
| ***F25D 23/04*** | (2006.01) |
| ***F25D 31/00*** | (2006.01) |

(52) U.S. Cl.

CPC ..... *F25D 25/04* (2013.01); *F25D 23/04* (2013.01); *F25D 23/08* (2013.01); *F25D 31/007* (2013.01); *F25D 2331/805* (2013.01)

(58) Field of Classification Search

CPC .. F25D 2331/805; F25D 31/007; F25D 25/04; F25D 2500/06; F25D 23/04; F25D 23/08; A47F 1/08; A47F 1/082; A47F 1/087; A47F 1/12; A47F 1/121; A47F 1/125; A47F 7/281; A47G 2029/144; B65D 25/04; B65D 25/10; B65D 25/103

USPC ..... 232/43.1, 43.5; 220/480–482, 507, 503, 220/555

See application file for complete search history.

(56) References Cited

U.S. PATENT DOCUMENTS 1,298,848 A * 4/1919 Wineberg ..... F25D 31/007 312/36
1,673,812 A * 6/1928 Dunn ..... A47F 1/08 312/107

(Continued)

FOREIGN PATENT DOCUMENTS

DE 102008018230 A1 * 10/2009 ..... F25D 31/007
EP 1030141 A2 * 8/2000 ..... A47F 1/04

(Continued)

*Primary Examiner* — Andrew M Roersma
(74) *Attorney, Agent, or Firm* — Michael E. Tschupp; Andre Pallapies; Brandon G. Braun

(57) ABSTRACT

A can dispenser rack for a refrigerator door, includes a housing in which a rear wall, two side walls, a central partition portion, L-shaped and T-shaped front flanges, and a bottom wall portion define two vertical side-by-side can receiving receptacles each having a top opening for loading cans and a lower opening for removal of cans, with each of the can receiving receptacles being configured to receive a plurality of cans stacked on their sides in a single column. The bottom wall portion has at least one rounded inner portion shaped to receive a side wall of a bottommost can in each can receiving receptacle, and at least one can retaining lip portion extending up from a front of the bottom wall portion to define a lower edge of the lower opening in each can receiving receptacle.

21 Claims, 6 Drawing Sheets

(56) References Cited

U.S. PATENT DOCUMENTS

| | | | | | |
|---|---|---|---|---|---|
| 1,714,469 | A * | 5/1929 | Hoffman | A47F 1/08 | 242/146 |
| 2,728,623 | A * | 12/1955 | Foerstner | F25D 23/04 | 211/49.1 |
| 2,826,471 | A * | 3/1958 | Fonda | F25D 23/04 | 221/311 |
| 2,903,315 | A * | 9/1959 | Schory | F25D 23/04 | 312/405.1 |
| 3,018,001 | A * | 1/1962 | Combs | A47F 1/08 | 221/242 |
| 3,805,964 | A * | 4/1974 | Titus, Jr. | F25D 25/02 | 312/35 |
| 4,542,830 | A * | 9/1985 | Effort | A47F 5/112 | 211/49.1 |
| 5,356,033 | A | 10/1994 | Delaney | | |
| 5,396,997 | A | 3/1995 | Johnson | | |
| 6,427,866 | B1 * | 8/2002 | Hawker | A47F 1/08 | 221/241 |
| 6,694,771 | B2 | 2/2004 | Kim | | |
| D527,749 | S | 9/2006 | Eveland | | |
| 7,377,123 | B2 | 5/2008 | Byrne | | |
| 8,147,016 | B2 | 4/2012 | Kwon | | |
| 8,608,263 | B2 * | 12/2013 | Eveland | A47F 1/087 | 312/405.1 |
| 8,746,818 | B2 | 6/2014 | Meese | | |
| 8,844,311 | B2 | 9/2014 | Bowen | | |
| 9,400,132 | B2 * | 7/2016 | Shrader | F25D 23/02 | |
| 9,671,154 | B1 | 6/2017 | Shrader | | |
| 2005/0127015 | A1 * | 6/2005 | Medcalf | A47F 1/087 | 211/59.2 |
| 2010/0018989 | A1 | 1/2010 | Kraemer | | |

FOREIGN PATENT DOCUMENTS

| | | | | |
|---|---|---|---|---|
| FR | 2731888 | A1 * | 9/1996 | A47B 96/1425 |
| JP | H-0968381 | A * | 3/1997 | F25D 23/04 |
| KR | 20140110477 | A * | 9/2014 | F25D 23/04 |
| WO | WO-02080738 | A1 * | 10/2002 | A47F 1/121 |
| WO | WO-2007110444 | A2 * | 10/2007 | A47F 1/12 |

* cited by examiner

CAN DISPENSER RACK FOR REFRIGERATOR DOOR

FIELD OF THE INVENTION

The present disclosure relates generally to domestic or household appliances such as refrigerators and, more particularly, to a can dispenser rack for a door of a refrigerator appliance.

The present disclosure further relates to a can dispenser rack that can be installed behind a dispenser housing of an external ice and/or water dispenser, for example, in a door of a French door-bottom mount style refrigerator appliance.

BACKGROUND OF THE INVENTION

In general, beverage container dispensers for appliances like refrigerators are known. However, these known beverage container dispensers are often complicated and cumbersome and take up too much space in the fresh food compartment, or are simply wire or rail members installed within recesses of the refrigerator door liner.

SUMMARY OF THE INVENTION

The present disclosure provides a can dispenser rack for a refrigerator door that makes optimal use of the space behind a dispenser housing by installing the can dispenser rack to extend vertically in what is normally unused space or underused space. Such underuse can include the placement of small, shallow food storage door bins which are unpopular with customers.

The present disclosure thus provides the customers a dedicated space for placing beverage cans offering easy access without sacrificing usable internal refrigerator space. The present disclosure addresses a customer pain point in refrigerator products having external dispensers; namely, the limited space that is available on door bins located behind the dispenser cavity. The present disclosure maximizes this space to store and access cans conveniently.

According to one aspect, the present disclosure provides a can dispenser rack for a refrigerator door, comprising: a housing which has a rear wall, two side walls extending from the rear wall, a central partition portion extending from the rear wall between the two side walls, and a bottom wall portion, with the two side walls having L-shaped front flanges turned inwardly to face each other when viewed from above, and the central partition portion having a T-shaped front flange when viewed from above, wherein the rear wall, the two side walls, the central partition portion, the L-shaped and T-shaped front flanges, and the bottom wall portion define two vertical side-by-side can receiving receptacles each having a top opening for loading cans and a lower opening for removal of cans, with each of the can receiving receptacles being configured to receive a plurality of cans stacked on their sides in a single column, and wherein the bottom wall portion has at least one rounded inner portion shaped to receive a side wall of a bottommost can in each can receiving receptacle, and at least one can retaining lip portion extending up from a front of the bottom wall portion to define a lower edge of the lower opening in each can receiving receptacle.

According to another aspect, the L-shaped and T-shaped front flanges form two vertical open slots therebetween and extending from the top opening to the lower opening at a front portion of the housing, the slots adapted to expose cans to cold temperatures of a refrigerator compartment and to show a brand or type of beverage.

According to another aspect, at the top opening of each of the can receiving receptacles, the rear wall has a portion that flares back rearward such that the top opening is wider in a front to rear direction as compared to a remainder of a corresponding can receiving receptacle.

According to another aspect, the rear wall has at least one hanger adapted to hang the can dispenser rack on an inner side of the refrigerator door such as on a refrigerator door bin.

According to another aspect, the at least one hanger comprises an upper hanger and a lower hanger that are adapted to hang on a mounting extension arm of an upper storage bin and a mounting extension arm of a lower storage bin, respectively, mounted to the inner side of the refrigerator door.

According to another aspect, the upper hanger and the lower hanger are L-shaped in cross-section and face downward and are adapted to fit over the mounting extension arm of the upper storage bin and the mounting extension arm of the lower storage bin, respectively, which are L-shaped in cross-section and face upward.

According to another aspect, the upper storage bin and the mounting extension arm of the upper storage bin and the lower storage bin and the mounting extension arm of the lower storage bin are mounted to the inner side of the refrigerator door such that the upper and lower storage bins are disposed at a lateral side of a dispenser housing of an external ice and/or water dispenser, the mounting extension arms of the upper and lower storage bins are disposed behind the dispenser housing, and the can dispenser rack is adapted to be installed behind the dispenser housing.

According to another aspect, the can dispenser rack is formed of one of a transparent plastic or an opaque plastic.

According to another aspect, the can dispenser rack is formed of a single piece of plastic.

According to another aspect, the lower opening in each can receiving receptacle is defined between the at least one can retaining lip portion and lower edges of the L-shaped and T-shaped front flanges at a front portion of the housing, and by a corresponding one of the two side walls.

According to another aspect, the rear wall has at least one vertically extending opening communicating with each can receiving receptacle adapted to expose cans to cold temperatures of a refrigerator compartment.

According to another aspect, the bottom wall portion has a slot extending from front to rear under each can receiving receptacle and adapted to expose cans for ease of dispensing from the can dispenser rack.

According to another aspect, the present disclosure provides a refrigerator comprising: a fresh food compartment; at least one refrigerator door; a dispenser housing for an external ice and/or water dispenser disposed on the at least one refrigerator door; at least one storage bin having a mounting extension arm mounted to an inner side of the at least one refrigerator door, such that the at least one storage bin is disposed at a lateral side of the dispenser housing and the mounting extension arm of the at least one storage bin is disposed behind the dispenser housing; and a can dispenser rack having at least one hanger that hangs on the mounting extension arm of the at least one storage bin, such that the can dispenser rack is installed behind the dispenser housing.

According to another aspect of the refrigerator, the can dispenser rack comprises: a housing which has a rear wall, two side walls extending from the rear wall, a central partition portion extending from the rear wall between the two side walls, and a bottom wall portion, with the two side walls having L-shaped front flanges turned inwardly to face each other when viewed from above, and the central partition portion having a T-shaped front flange when viewed from above, wherein the rear wall, the two side walls, the central partition portion, the L-shaped and T-shaped front flanges, and the bottom wall portion define two vertical side-by-side can receiving receptacles each having a top opening for loading cans and a lower opening for removal of cans, with each of the can receiving receptacles being configured to receive a plurality of cans stacked on their sides in a single column, and wherein the bottom wall portion has at least one rounded inner portion shaped to receive a side wall of a bottommost can in each can receiving receptacle, and at least one can retaining lip portion extending up from a front of the bottom wall portion to define a lower edge of the lower opening in each can receiving receptacle.

According to another aspect of the refrigerator, the L-shaped and T-shaped front flanges form two vertical open slots therebetween and which extend from the top opening to the lower opening at a front portion of the housing, the slots serving to expose cans to cold temperatures of the fresh food compartment and to show a brand or type of beverage.

According to another aspect of the refrigerator, the at least one storage bin comprises an upper storage bin having a mounting extension arm and a lower storage bin having a mounting extension arm, and the at least one hanger comprises an upper hanger and a lower hanger that are L-shaped in cross-section and face downward and fit over the mounting extension arm of the upper storage bin and the mounting extension arm of the lower storage bin, respectively, which are L-shaped in cross-section and face upward.

According to another aspect of the refrigerator, the can dispenser rack is formed of one of a transparent plastic or an opaque plastic.

According to another aspect of the refrigerator, the lower opening in each can receiving receptacle is defined between the at least one can retaining lip portion and lower edges of the L-shaped and T-shaped front flanges at a front portion of the housing, and by a corresponding one of the two side walls.

According to another aspect of the refrigerator, the bottom wall portion has a slot extending from front to rear under each can receiving receptacle and adapted to expose cans for ease of dispensing from the can dispenser rack.

According to another aspect of the refrigerator, the can dispenser rack is formed of a single piece of plastic and is removable from the at least one refrigerator door.

According to another aspect, the present disclosure provides a can dispenser rack for a refrigerator door, comprising: a housing which defines two vertical side-by-side can receiving receptacles each having a top opening for loading cans and a lower opening for removal of cans, with each of the can receiving receptacles being configured to receive a plurality of cans stacked on their sides in a single column, and wherein the housing includes a bottom wall portion having at least one rounded inner portion shaped to receive a side wall of a bottommost can in each can receiving receptacle, and at least one can retaining lip portion extending up from a front of the bottom wall portion to define a lower edge of the lower opening in each can receiving receptacle.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 5:
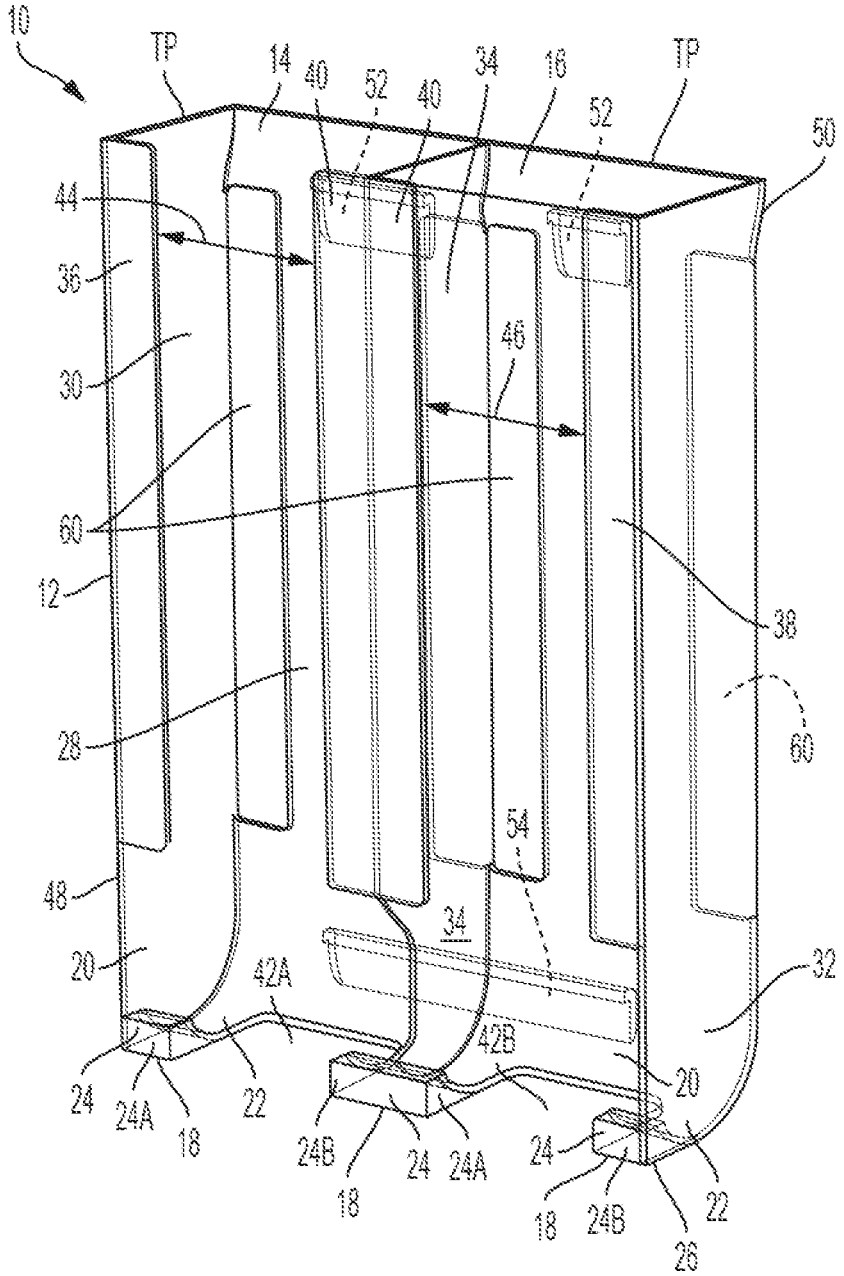
Figure 6B:
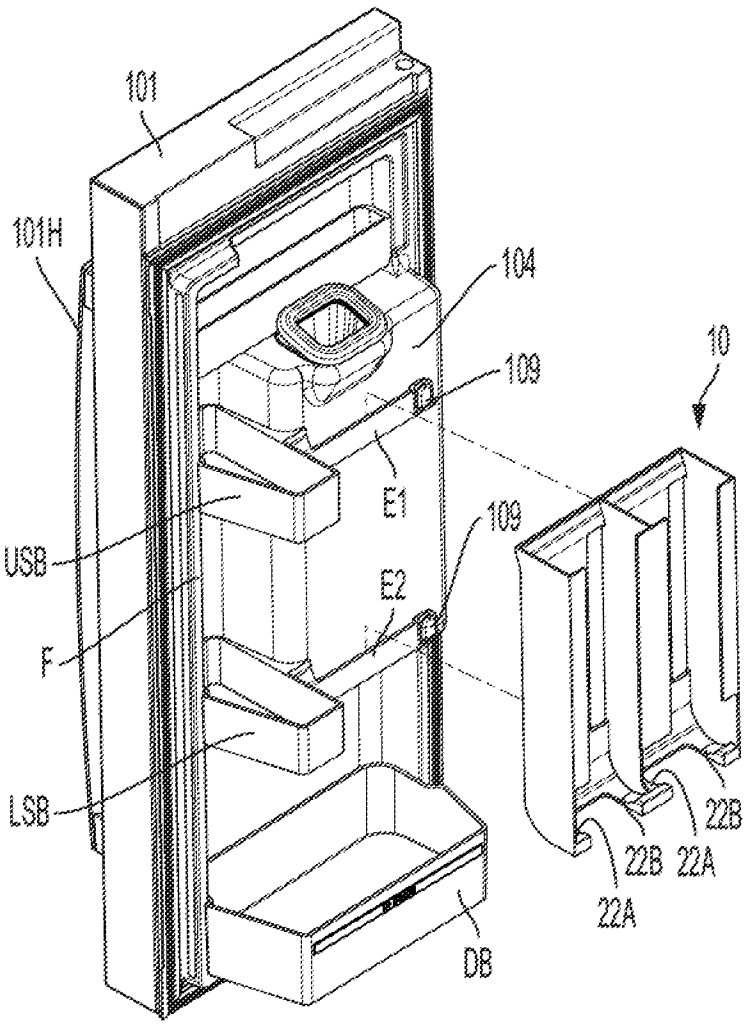
Figure 6A:
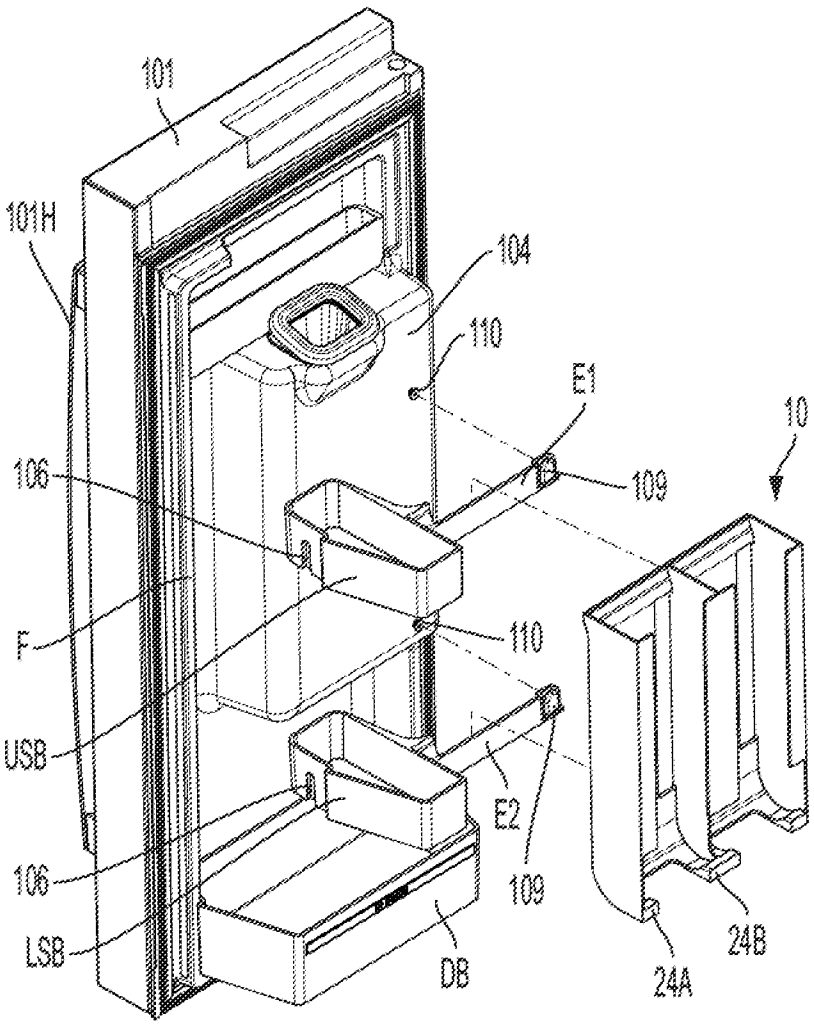

FIG. 5 is a perspective view showing a can dispenser rack per se removed from the back of the door according to an exemplary embodiment consistent with the present disclosure; and FIGS. 6A and 6B show the installation of the two door bins each with a rack holder, and the installation or hanging of the can dispenser rack on the rack holders, respectively, on the back of the refrigerator door according to an exemplary embodiment consistent with the present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, middle, upper, lower, right side, left side, vertical, horizontal, downward, upward, and the like used herein are for orientation purposes with respect to the drawings when describing the exemplary embodiments and should not limit the present invention unless explicitly indicated otherwise in the claims. Also, terms such as substantially, approximately, and about are intended to allow for variances to account for manufacturing tolerances, measurement tolerances, or variations from ideal values that would be accepted by those skilled in the art.

Figure 1:
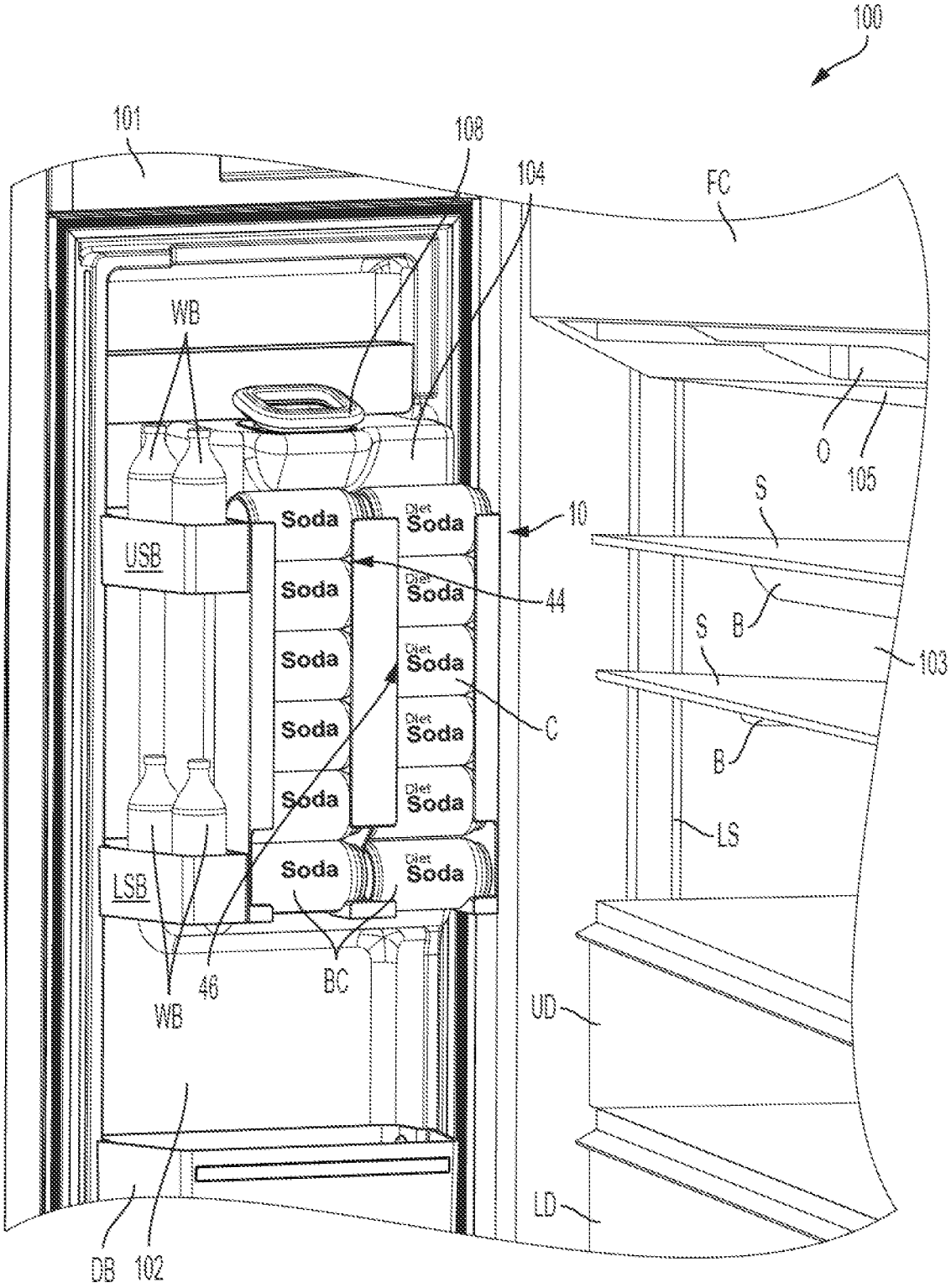
FIG. 1 is a partial perspective view showing the left door open at the upper portion of a French door-bottom mount style refrigerator and having a can dispenser rack on the back or inner side of the door according to an exemplary embodiment consistent with the present disclosure.
Figure 3:
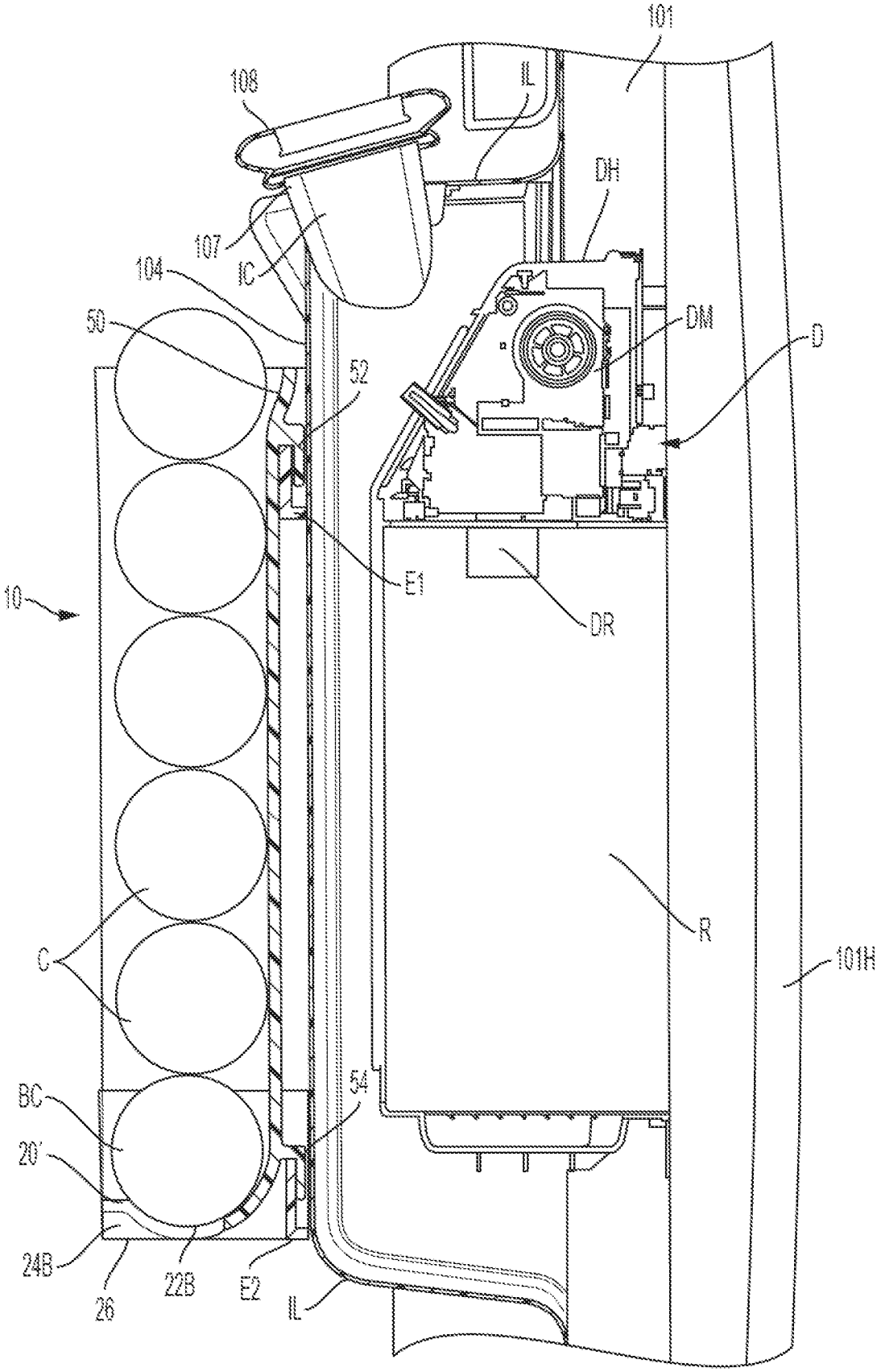
FIG. 3 is a vertical sectional view through the can dispenser rack, an external ice/water dispenser, and a portion of the door inner liner and door of the refrigerator according to an exemplary embodiment consistent with the present disclosure.

FIG. 1 shows the upper portion of a French door-bottom mount (FDBM) style refrigerator appliance 100 (also sometimes referred to as refrigerator 100) includes an insulated body comprising as a foamed housing having two doors (only the left door 101 being in view and shown open) for closing a fresh food compartment 103 (also referred to as a refrigerator compartment 103) and having a can dispenser rack 10 on the back or inner side 102 (also sometimes referred to as the inside 102) of the left door 101 according to an exemplary embodiment consistent with the present disclosure. FIG. 3 shows a door handle 101H, but the doors can be handle-less. Although not shown in the figures, the FDBM style refrigerator 100 normally has a bottom freezer compartment which is accessed using a pull out drawer type of configuration. One or more middle or flexible type drawers that have an independently adjustable temperature can also be included between the top fresh food compartment 103 and the bottom freezer compartment (not shown). With reference to FIG. 1, the fresh food compartment 103 includes, for example, a number of shelves S, a lower drawer LD, an upper drawer UD (there can also be two drawers on the right side), and full size door bins such as door bin DB in the door 101. The shelves S are supported by shelf support railings or shelf support brackets B that include hooks (not shown) at the rear for connection to and adjustment along vertical tracks (not shown) formed by separate metal strips having openings such as slots or holes (not shown) therein and arranged along a wall (e.g., a rear wall (not shown) of the refrigerator compartment 103). The fresh food or refrigerator compartment 103 is typically set in a range of 1° C. to 6° C., and the freezer compartment is typically set at −18° C. or colder.

FIG. 3 is a vertical sectional view through the can dispenser rack 10, an external ice/water dispenser D, and a portion of the door inner liner IL and door 101 of the refrigerator 100 according to an exemplary embodiment consistent with the present disclosure. As best shown in FIG. 3, the door 101 includes the external ice/water dispenser D and a recessed portion forming a dispensing region R for the user to place their glass or other drinking container to fill it with water and/or ice. The external ice/water dispenser D includes a dispenser housing DH, a dispensing mechanism DM and a water dispensing nozzle and ice dispensing portion (not shown). DR denotes an aesthetic part referred to as a design ring. As can be seen in especially FIGS. 3 and 4, the recessed portion forming a dispensing region R forms a projected portion 104 on the inside 102 of the refrigerator door 101 where the inner liner IL projects inwardly into the fresh food compartment 103. As shown in FIGS. 1-4, 6A, and 6B, an ice chute IC is disposed at the top of the projected portion 104 on the inside 102 of the refrigerator door 101. The ice chute IC is configured to communicate with an outlet opening O of an ice bucket front cover FC of an insulated ice compartment 105 arranged at the upper left side in the fresh food compartment 103 when the door 101 is fully closed. For example, the outlet opening O can be formed at the bottom of the front cover FC of a removable ice bucket through which ice pieces are delivered when a user dispenses ice pieces. The outlet opening O cooperates with an ice chute extension 107 to deliver ice pieces to the dispenser D when the door 101 is in a closed position. The interface between the outlet opening O and the top of the ice chute extension 107 can be sealed with a gasket 108, have a partial or open gasket, or have no gasket at all. In the latter two cases, some air is permitted to move between the fresh food compartment 103 and the insulated ice compartment 105 by moving into the region inside the ice chute extension 107 and through the outlet opening O and into the insulated ice compartment 105 and vice versa. The insulated ice compartment 105 includes an ice maker, the removable ice bucket or ice storage bin, an auger, ice crushing blades, and the like (all not shown) as is known in the art. A light strip LS can be disposed on the side wall of the fresh food compartment 103 as shown in FIG. 1.

Figure 4:
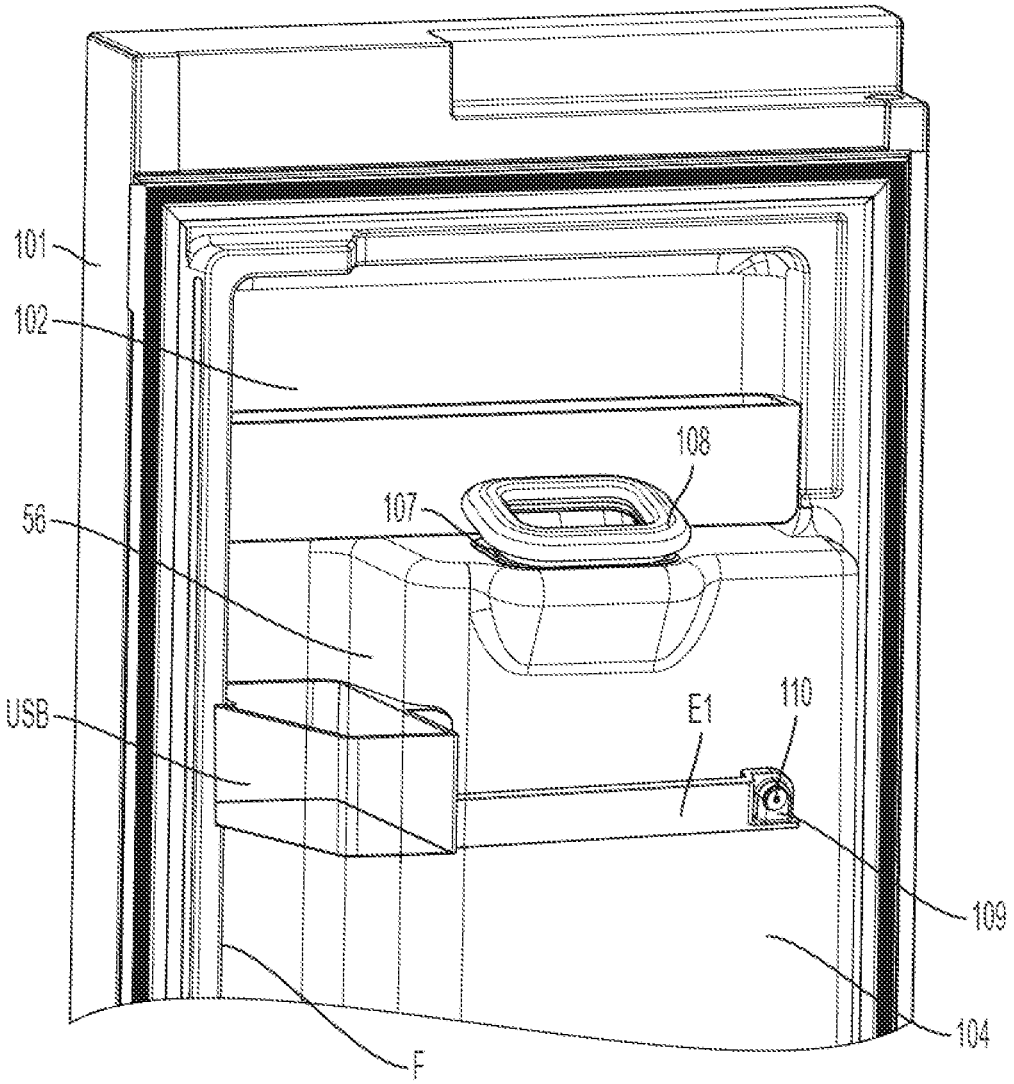
FIG. 4 is a perspective view showing the inside of the left door per se of a French door-bottom mount style refrigerator and having the can dispenser rack removed from the back of the door according to an exemplary embodiment consistent with the present disclosure.

As best shown in FIGS. 4, 6A, and 6B, the inner side 102 of the door 101 also has at least one storage bin (the upper storage bin USB being shown in FIG. 4) having a rack holder such as a mounting extension arm E1 mounted to an inner side of the refrigerator door 101, such that the at least one storage bin is disposed at a lateral side of the dispenser housing (which faces outward toward the user when the door 101 is open) and the mounting extension arm E1 of the at least one storage bin is disposed behind the dispenser housing DH (see FIG. 3). Preferably, there is an upper storage bin USB and a lower storage bin LSB. FIG. 1 shows the upper storage bin USB and the lower storage bin LSB holding several water bottles WB in an upright orientation. The upper storage bin USB and the mounting extension arm E1 of the upper storage bin USB and the lower storage bin LSB and a rack holder which can take the form of a mounting extension arm E2 of the lower storage bin LSB are mounted to the inner side of the refrigerator door 101 such that the upper and lower storage bins USB, LSB are disposed at the lateral side 56 of the projected portion 104 of the dispenser housing DH of an external ice and/or water dispenser D, and the mounting extension arms E1 and E2 of the upper and lower storage bins USB and LBS, respectively, are disposed behind the dispenser housing DH which projects into the fresh food compartment 103. As shown in FIG. 6A, the sides of the upper and lower storage bins USB and LBS can have female keyways or slots 106 which slide over male counterparts (not shown) fastened to the inside 102 of the door 101 such as at the inside of the flange F. Likewise, the mounting extension arms E1 and E2 of the upper and lower storage bins USB and LBS, respectively, can have female keyways or slots 109 which slide over male counterparts 110 fastened to the inside of the door 101 such as to the inner liner IL behind the dispenser housing DH (see FIGS. 4 and 6A). Moreover, each of the mounting extension arms E1 and E2 of the upper and lower storage bins USB and LBS, respectively, is L-shaped in cross-section and faces upward as best shown in FIG. 3. The L-shaped cross-section allows the mounting extension arms E1 and E2 to serve as fixed hangers or rack holders for receiving an upper hanger and a lower hanger of the can dispenser rack 10 that are configured to hang on the mounting extension arm E1 of the upper storage bin USB and the mounting extension arm E2 of the lower storage bin LSB, respectively, mounted to the inside 102 of the refrigerator door 101, as will be described in more detail below.

Figure 2:
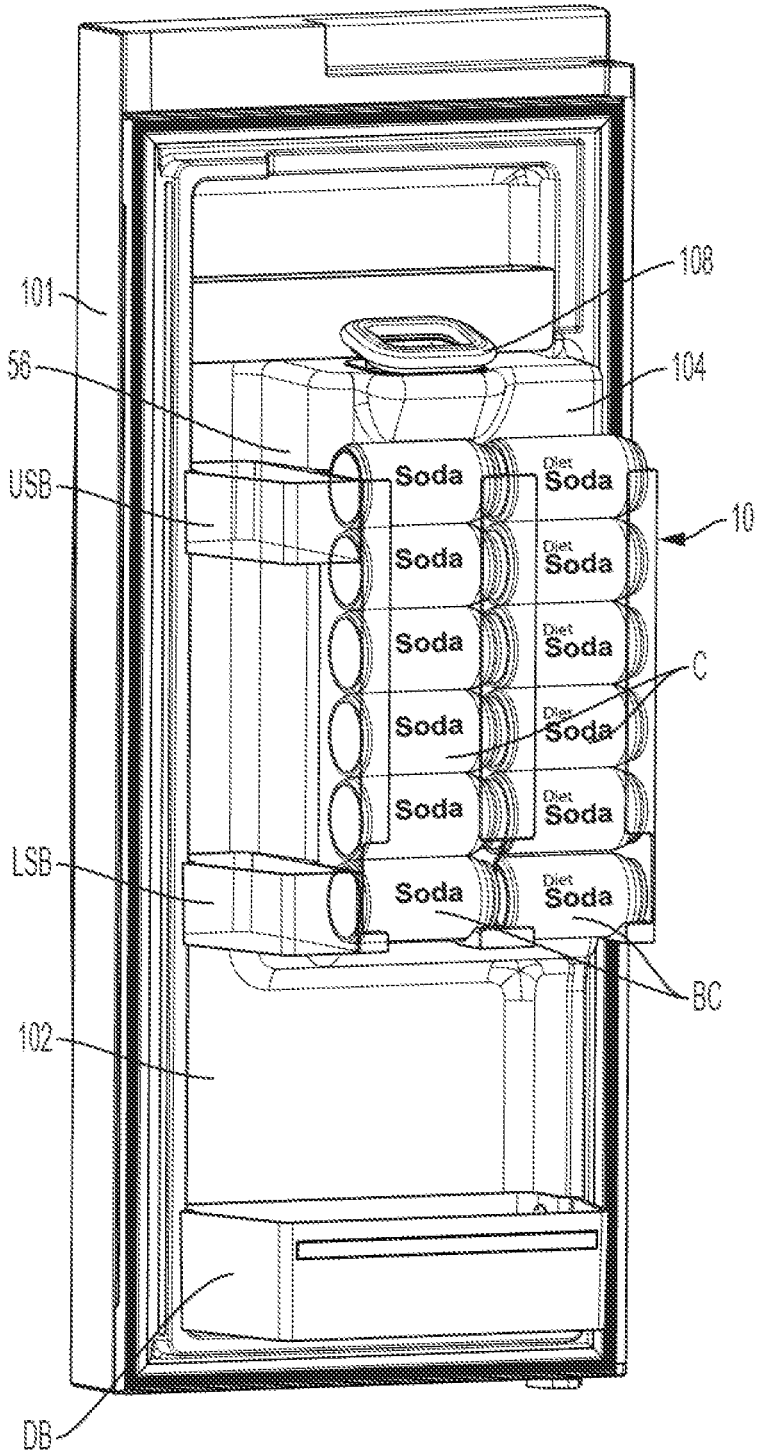
FIG. 2 is a perspective view showing the inner side of the left door per se of a French door-bottom mount style refrigerator and having a can dispenser rack on the back of the door according to an exemplary embodiment consistent with the present disclosure.

With reference to FIG. 5, in general, the can dispenser rack 10 comprises a housing 12 shown as being formed, for example, of a transparent plastic which defines two vertical side-by-side can receiving receptacles 14 and 16 each having a top opening TP for loading cans C and a lower opening 20 for removal of cans C, with each of the can receiving receptacles 14 and 16 being configured to receive a plurality of cans C stacked on their sides in a single column (see FIGS. 1-3). For example, but not limited thereto, each of the can receiving receptacles 14 and 16 can accommodate six 12 once/355 milliliter regular beverage cans C for a total capacity of twelve cans C, as shown in FIGS. 1-2. The housing 12 includes a bottom wall portion 18 having at least one rounded inner portion 22 shaped to receive a side wall of a bottommost can BC in each can receiving receptacle 14 and 16, and at least one can retaining lip portion 24 extending up from a front 26 of the bottom wall portion 18 to define a lower edge 20' (see FIG. 3) of the lower opening 20 in each can receiving receptacle 14 and 16.

More specifically, as shown in FIG. 5, the housing 12 has a rear wall 28, two side walls 30 and 32 extending from the rear wall 28, a central partition portion 34 extending from the rear wall 28 between the two side walls 30 and 32, and the bottom wall portion 18, with the two side walls 30 and 32 having L-shaped front flanges 36 and 38, respectively, turned inwardly to face each other when viewed from above, and the central partition portion 34 having a T-shaped front flange 40 when viewed from above. The rear wall 28, the two side walls 30 and 32, the central partition portion 34, the L-shaped flanges 36 and 38, and T-shaped front flange 40, and the bottom wall portion 18 define the two vertical side-by-side can receiving receptacles 14 and 16. The at least one can retaining lip portion 24 extending up from the front 26 of the bottom wall portion 18 can take the form of two segments 24A and 24B for each receptacle 14 and 16. The segments 24A and 24B are formed by slots 42A and 42B extending from front to rear in the bottom wall portion 18 under each can receiving receptacle 14 and 16, respectively, and adapted to expose cans C for ease of dispensing from the can dispenser rack 10. The segments 24A and 24B have corresponding rounded inner portion segments 22A and 22B that form the at least one rounded inner portion 22. The rear wall 28 has at least one vertically extending opening 60 communicating with each can receiving receptacle 14 and 16 adapted to expose the cans C to the cold temperatures of the refrigerator compartment 103. Preferably, there are two vertically extending openings 60 communicating with each can receiving receptacle 14 and 16, as shown in FIG. 5.

As best shown in FIGS. 1, 2, and 5, the L-shaped and T-shaped front flanges 36, 38, and 40 form two vertical open slots 44 and 46 therebetween and extending from the top opening TP to the lower opening 20 at a front portion 48 of the housing 12. The slots 44 and 46 serve to expose cans C to the cold temperatures of the refrigerator compartment 103 and to show a brand or type of beverage.

As shown in FIGS. 3 and 5, at the top opening TP of each of the can receiving receptacles 14 and 16, the rear wall 28 has a portion 50 that flares back rearward such that the top opening TP is wider in a front to rear direction as compared to a remainder of a corresponding can receiving receptacle 14, 16. This facilitates the loading of cans C into the can receiving receptacles 14 and 16 by the user. The lower opening 20 in each can receiving receptacle 14, 16 is defined between the can retaining lip portion 24 and lower edges of the L-shaped and T-shaped front flanges 36, 38, and 40 at the front portion 48 and by the corresponding side wall 30, 32 of the housing 12. As shown in FIGS. 1, 3, and 6B, the rounded inner portion segments 22A and 22B of the at least one rounded inner portion 22 are shaped to receive a side wall of a bottommost can BC in each can receiving receptacle 14 and 16, and the at least one can retaining lip portion 24 extends up from a front 26 of the bottom wall portion 18 to define the lower edge 20' (see FIG. 3) of the lower opening 20 in each can receiving receptacle 14 and 16. These two aspects together: 1) the rounded inner portion 22, and 2) the can retaining lip portion 24 defining the lower edge 20', serve to retain the bottommost can BC in the corresponding receptacle 14, 16 until the user dispenses the bottommost can BC from the can dispenser rack 10.

The can dispenser 10 has at least one hanger and preferably comprises an upper hanger 52 and a lower hanger 54 that are configured to hang on the mounting extension arm E1 of the upper storage bin USB and the mounting extension arm E2 of the lower storage bin LSB, respectively, mounted to the inner side 102 of the refrigerator door 101. The upper hanger 52 and the lower hanger 54 are L-shaped in cross-section and face downward and are configured to fit over the mounting extension arm E1 of the upper storage bin USB and the mounting extension arm E2 of the lower storage bin LSB, respectively, which, as noted above, are L-shaped in cross-section and face upward. The upper hanger 52 is shown as two separate pieces in FIG. 5, since the vertically extending openings 60 divide up an upper portion of the rear wall 28. On the other hand, the lower hanger 54 is a single piece that extends behind both can receiving receptacles 14 and 16. Because the upper storage bin USB and the mounting extension arm E1 of the upper storage bin USB and the lower storage bin LSB and the mounting extension arm E2 of the lower storage bin LSB are mounted to the inner side 102 of the refrigerator door 101 such that the upper and lower storage bins USB and LSB are disposed at a lateral side 56 of the projected portion 104 of the dispenser housing DH of the external ice and/or water dispenser D, the mounting extension arms E1 and E2 of the upper and lower storage bins USB and LSB are disposed behind the dispenser housing DH, and the can dispenser rack 10 can thus be installed behind the dispenser housing DH. This accordingly provides a dedicated space for placing beverage cans offering easy access without sacrificing usable internal refrigerator space. Also, because the can dispenser rack 10 is hung or installed using hangers 52, 54, the can dispenser rack 10 is easily removable from behind the dispenser housing DH by simply lifting the can dispenser rack 10 upward and away from the inside 102 of the door 101.

The can dispenser rack 10 is preferably formed of one of a transparent plastic (see FIGS. 2 and 5) or an opaque plastic (see FIG. 1). The can dispenser rack 10 is preferably formed of a single piece of plastic (see FIG. 5). A suitable plastic includes but is not limited to, for example, acrylonitrile butadiene styrene (ABS), Polystyrene (PS), styrene acrylonitrile (SAN), polycarbonate (PC). Of course, other materials such as aluminum or other metals can also be used.

FIG. 6A shows the installation of the upper and lower storage bins USB and LSB and the mounting extension arms E1 and E2 of the upper and lower storage bins USB and LSB to the inside 102 of the door 101 using the female keyways or slots 109 which slide over male counterparts 110 fastened to the inside of the door 101, and FIG. 6B shows the hanging of the can dispenser rack 10 on the mounting extension arms E1 and E2 using the hangers 52 and 54 (see FIG. 3). The can dispenser rack 10 can thus be installed behind the dispenser housing DH on the projected portion 104 of the dispenser housing DH.

The present invention has substantial opportunity for variation without departing from the spirit or scope of the present invention. For example, while FIGS. 1-4, 6A, and 6B show a traditional FDBM style refrigerator appliance 100, the present invention can be utilized in single door fresh food compartment-bottom mount freezer style refrigerator appliance, or in FDBM configurations with one or more intermediate compartments (such as, but not limited to, pullout drawers) that can be operated as either fresh food compartments or freezer compartments and which are located between the main fresh food compartment and the main freezer compartment, or in a side-by-side refrigerator where the refrigerator compartment and the freezer compartment are disposed side-by-side in a vertical orientation, as well as in other well-known refrigerator configurations, such as but not limited to, top freezer configurations, bottom freezer configurations, configurations where the entire refrigerator unit is a fresh food compartment from top to bottom without a freezer compartment, or panel front type refrigeration and freezer configurations, and the like.

Also, the various features described in connection with a particular embodiment can be used (mixed and matched) with the other embodiments wherever appropriate.

Those skilled in the art will recognize improvements and modifications to the exemplary embodiments of the present invention. All such improvements and modifications are considered within the scope of the concepts disclosed herein and the claims that follow.

What is claimed is:

1. A can dispenser rack for a refrigerator door, comprising:

a housing which has a rear wall, two side walls extending from the rear wall, a central partition portion extending from the rear wall between the two side walls, and a bottom wall portion, with the two side walls having L-shaped front flanges turned inwardly to face each other when viewed from above, and the central partition portion having a T-shaped front flange when viewed from above, wherein the rear wall, the two side walls, the central partition portion, the L-shaped and T-shaped front flanges, and the bottom wall portion define two vertical side-by-side can receiving receptacles each having a top opening for loading cans and a lower opening for removal of cans, with each said can receiving receptacle being configured to receive a plurality of cans stacked on sides thereof in a single column, wherein at the top opening of each said can receiving receptacle, the rear wall has a portion that flares back rearward such that the top opening of each said can receptacle is wider in a front to rear direction as compared to a remainder of each said can receiving receptacle, and wherein the bottom wall portion has at least one rounded inner portion shaped to receive a side wall of a bottommost can in each said can receiving receptacle, and at least one can retaining lip portion extending up from a front of the bottom wall portion to define a lower edge of the lower opening in each said can receiving receptacle.

2. The can dispenser rack of claim 1, wherein the L-shaped and T-shaped front flanges form two vertical open slots therebetween and which extend from the top opening to the lower opening at a front portion of the housing, the slots adapted to expose cans to cold temperatures of a refrigerator compartment and to show a brand or type of beverage.

3. The can dispenser rack of claim 1, wherein the can dispenser rack is formed of one of a transparent plastic or an opaque plastic.

4. The can dispenser rack of claim 1, wherein the can dispenser rack is formed of a single piece of plastic.

5. The can dispenser rack of claim 1, wherein the lower opening in each said can receiving receptacle is defined between the at least one can retaining lip portion and lower edges of the L-shaped and T-shaped front flanges at a front portion of the housing, and by a corresponding one of the two side walls.

6. The can dispenser rack of claim 1, wherein the rear wall has at least one vertically extending opening communicating with each said can receiving receptacle adapted to expose cans to cold temperatures of a refrigerator compartment.

7. The can dispenser rack of claim 1, wherein the bottom wall portion has a slot extending from front to rear under each said can receiving receptacle and adapted to expose cans for ease of dispensing from the can dispenser rack.

8. A refrigerator comprising:

a fresh food compartment;

at least one refrigerator door;

a dispenser housing for an external ice and/or water dispenser disposed on the at least one refrigerator door;

at least one storage bin having a mounting extension arm mounted to an inner side of the at least one refrigerator door, such that the at least one storage bin is disposed at a lateral side of the dispenser housing and the mounting extension arm of the at least one storage bin is disposed behind the dispenser housing; and a can dispenser rack having at least one hanger that hangs on the mounting extension arm of the at least one storage bin, such that the can dispenser rack is installed behind the dispenser housing.

9. The refrigerator of claim 8, wherein the can dispenser rack comprises:

a housing which has a rear wall, two side walls extending from the rear wall, a central partition portion extending from the rear wall between the two side walls, and a bottom wall portion, with the two side walls having L-shaped front flanges turned inwardly to face each other when viewed from above, and the central partition portion having a T-shaped front flange when viewed from above, wherein the rear wall, the two side walls, the central partition portion, the L-shaped and T-shaped front flanges, and the bottom wall portion define two vertical side-by-side can receiving receptacles each having a top opening for loading cans and a lower opening for removal of cans, with each of the can receiving receptacles being configured to receive a plurality of cans stacked on sides thereof in a single column, and wherein the bottom wall portion has at least one rounded inner portion shaped to receive a side wall of a bottommost can in each said can receiving receptacle, and at least one can retaining lip portion extending up from a front of the bottom wall portion to define a lower edge of the lower opening in each can receiving receptacle.

10. The refrigerator of claim 9, wherein the L-shaped and T-shaped front flanges form two vertical open slots therebetween and extending from the top opening to the lower opening at a front portion of the housing, the slots serving to expose cans to cold temperatures of the fresh food compartment and to show a brand or type of beverage.

11. The refrigerator of claim 8, wherein the at least one storage bin comprises an upper storage bin having a mounting extension arm and a lower storage bin having a mounting extension arm, and the at least one hanger comprises an upper hanger and a lower hanger that are L-shaped in cross-section and face downward and fit over the mounting extension arm of the upper storage bin and the mounting extension arm of the lower storage bin, respectively, which are L-shaped in cross-section and face upward.

12. The refrigerator of claim 8, wherein the can dispenser rack is formed of one of a transparent plastic or an opaque plastic.

13. The refrigerator of claim 9, wherein the lower opening in each said can receiving receptacle is defined between the at least one can retaining lip portion and lower edges of the L-shaped and T-shaped front flanges at a front portion of the housing, and by a corresponding one of the two side walls.

14. The refrigerator of claim 9, wherein the bottom wall portion has a slot extending from front to rear under each said can receiving receptacle and adapted to expose cans for ease of dispensing from the can dispenser rack.

15. The refrigerator of claim 8, wherein the can dispenser rack is formed of a single piece of plastic and is removable from the at least one refrigerator door.

16. An assembly of a refrigerator door inner liner and a can dispenser rack for a refrigerator door having an external ice and/or water dispenser disposed therein, comprising:

a projected portion on the door inner liner for accommodating the external ice and/or water dispenser in an assembled state;

an upper storage bin with an associated mounting extension arm mounted to the projected portion of the door inner liner;

a housing which defines of the can dispenser rack including a rear wall, two side walls extending from the rear wall, and a bottom wall collectively defining two vertical side-by-side can receiving receptacles each having a top opening for loading cans and a lower opening for removal of cans, the bottom wall portion having at least one rounded inner portion shaped to receive a side wall of a bottommost can in each said can receiving receptacle, and at least one can retaining lip portion extending up from a front of the bottom wall portion to define a lower edge of the lower opening in each said can receiving receptacle, with such that each of the said can receiving receptacles being receptacle is configured to receive a plurality of cans stacked on their sides thereof in a single column, and wherein the housing includes a bottom wall portion having at least one rounded inner portion shaped to receive a side wall of a bottommost can in each can receiving receptacle, and at least one can retaining lip portion extending up from a front of the bottom wall portion to define a lower edge of the lower opening in each can receiving receptacle at least one hanger located on the rear wall of the can dispenser rack housing, and wherein the can dispenser rack hangs on the projected portion of the door inner liner by engagement of the at least one hanger located on the rear wall of the can dispenser rack housing with the mounting extension arm of the upper storage bin that is mounted to the projected portion of the door inner liner.

17. The assembly of claim 16, further comprising a lower storage bin with an associated mounting extension arm mounted to the projected portion of the door inner liner.

18. The assembly of claim 17, wherein:

the at least one hanger located on the rear wall of the can dispenser rack housing comprises an upper hanger and a lower hanger, and the upper hanger is engaged with the mounting extension arm associated with the upper storage bin and the lower hanger is engaged with the mounting extension arm associated with the lower storage bin.

19. The assembly of claim 18, wherein the upper hanger and the lower hanger are L-shaped in cross-section and face downward, while the mounting extension arm associated with the upper storage bin and the mounting extension arm associated with the lower storage bin are L-shaped in cross-section and face upward.

20. The assembly of claim 17, wherein the upper storage bin and the lower storage bin are each disposed at a lateral side of the projected portion of the door inner liner.

21. The assembly of claim 17, further comprising:

a female slot in each of the upper storage bin mounting extension arm and the lower storage bin mounting extension arm, male counterparts fastened to the projected portion of the door inner liner, and wherein each said upper storage bin mounting extension arm and lower storage bin mounting extension arm are secured to the projected portion of the door inner liner by engagement of the female slots therein with corresponding ones of the male counterparts.

* * * * *